US012796810B2

(12) United States Patent
Chen

(10) Patent No.: US 12,796,810 B2
(45) Date of Patent: Nov. 17, 2026

(54) CONCAVE SQUARE TUBE STORAGE SHELF

(71) Applicant: Protrend Co., Ltd., Taipei City (TW)

(72) Inventor: Shun-Yi Chen, Taipei City (TW)

(73) Assignee: PROTREND CO., LTD., Taipei City (TW)

( * ) Notice: Subject to any disclaimer, the term of this patent is extended or adjusted under 35 U.S.C. 154(b) by 36 days.

(21) Appl. No.: 19/077,071

(22) Filed: Mar. 12, 2025

(65) Prior Publication Data

US 2026/0191324 A1 Jul. 9, 2026

(30) Foreign Application Priority Data

Jan. 9, 2025 (TW) ..... 114100832

(51) Int. Cl.
*A47B 57/16* (2006.01)
*A47B 47/00* (2006.01)

(52) U.S. Cl.
CPC ..... *A47B 57/16* (2013.01); *A47B 47/0083* (2013.01)

(58) Field of Classification Search
CPC ..... A47B 47/0083; A47B 57/08; A47B 57/10; A47B 57/16; A47B 57/20; A47B 57/22; A47B 57/32; A47B 57/34; A47B 57/40; A47B 57/48; A47B 57/50
See application file for complete search history.

(56) References Cited

U.S. PATENT DOCUMENTS 2,867,332 A * 1/1959 Adams ..... A47B 57/40 108/110
2,925,920 A * 2/1960 Skubic ..... A47B 57/402 108/107
3,303,937 A * 2/1967 Mcconnell ..... A47B 57/50 211/187
3,612,290 A * 10/1971 Evans ..... A47B 57/50 211/187
3,702,137 A * 11/1972 Evans ..... A47B 57/487 211/187
5,463,966 A * 11/1995 Nilsson ..... F16B 12/34 108/193

(Continued)

FOREIGN PATENT DOCUMENTS

CN 111067287 A * 4/2020 ..... A47B 96/1475
DE 102009004349 A1 * 11/2009 ..... A47B 96/066

(Continued)

*Primary Examiner* — Andrew Roersma
(74) *Attorney, Agent, or Firm* — WPAT, PC

(57) ABSTRACT

A concave square tube storage shelf includes post components, storage layers, and shelf boards. the post component comprises a concave square tube and at least one inclined hole group. The concave square tube comprises a first plate, a second plate, a third plate, and at least one concave plate. At least one concave plate is provided with the at least one inclined hole group. The inclined hole group comprises a first group of inclined holes and a second group of inclined holes. The first group of inclined hole and the second group of inclined holes are arranged side by side through the corresponding concave plate. The first group of inclined holes and the second group of inclined holes are respectively provided with two inclined holes along an assembly direction. The storage layer comprises a shelf rack and fasteners.

7 Claims, 12 Drawing Sheets

(56) References Cited

U.S. PATENT DOCUMENTS

| | | | | | |
|---|---|---|---|---|---|
| 6,112,913 | A * | 9/2000 | Rindoks | A47B 57/30 | 312/247 |
| 6,682,253 | B2 * | 1/2004 | Binna | F16L 3/243 | 52/653.2 |
| 6,920,831 | B2 * | 7/2005 | Lin | A47B 57/40 | 211/187 |
| 11,583,074 | B2 * | 2/2023 | Nilsson | A47B 47/022 | |
| 11,759,010 | B2 * | 9/2023 | Drew | A47B 96/1458 | 211/187 |
| 2017/0055701 | A1 * | 3/2017 | Latvis, Jr. | A47B 91/024 | |
| 2017/0280875 | A1 * | 10/2017 | Buckley | A47B 57/34 | |
| 2022/0071389 | A1 * | 3/2022 | Globerman | A47B 47/027 | |
| 2023/0129296 | A1 * | 4/2023 | Chakraborthy | A47B 47/0083 | 211/134 |
| 2023/0270248 | A1 * | 8/2023 | Hanlon | A47B 57/482 | |
| 2023/0363530 | A1 * | 11/2023 | Yoon | A47B 96/1408 | |
| 2024/0008641 | A1 * | 1/2024 | Briosi | A47B 57/402 | |

FOREIGN PATENT DOCUMENTS

| | | | | | |
|---|---|---|---|---|---|
| KR | 20100085398 | A * | 7/2010 | A47B 57/08 | |
| KR | 102310447 | B1 * | 10/2021 | A47F 5/10 | |
| KR | 102704956 | B1 * | 9/2024 | A47B 47/0091 | |
| WO | WO-2011000432 | A1 * | 1/2011 | A47B 47/0083 | |
| WO | WO-2012154111 | A1 * | 11/2012 | E04B 2/62 | |

* cited by examiner

CONCAVE SQUARE TUBE STORAGE SHELF

CROSS REFERENCE TO RELATED APPLICATION

This application claims the benefits of Taiwan application Serial No. 114100832, filed on Jan. 9, 2025, the disclosures of which are incorporated by references herein in its entirety.

TECHNICAL FIELD

The present disclosure relates to a storage shelf, and more particularly to a concave square tube storage shelf.

BACKGROUND

A combined type storage shelf is a storage shelf composed of multiple independent components (such as storage layers, connecting pieces, etc.) that can be assembled and used for storage. The design of combined type storage shelf usually emphasizes flexibility and scalability to meet the needs of home, office and other occasions.

Traditionally, there is a distinction between round columns (round tubes) and square columns (square tubes). If round post columns are used, they cannot be assembled horizontally, and the storage shelf cannot be effectively expanded in the traverse direction. Therefore, it seems advantageous to use square tubes. However, the traditional square tube and the structure of storage shelf are relatively complex and time-consuming to assemble, which also leads to disadvantages such as many manufacturing production, processing and packaging steps, and high costs.

SUMMARY

The present disclosure embodiment provides a concave square tube storage shelf, which has a simple structure, is relatively stable, and has improved convenience in use.

An embodiment of the present disclosure provides a concave square tube storage shelf comprising a plurality of post components, a plurality of storage layers, and a plurality of shelf boards. Each of the post components comprises a concave square tube and at least one inclined hole group. Each of the concave square tubes comprises a first plate, a second plate, a third plate, and at least one concave plate, each of the second plates and the corresponding third plate are parallel to each other, each of the first plates and the at least one concave plate are opposite sides, two sides of each of the first plates are respectively connected to the corresponding second plate and the corresponding third plate, two sides of each of the concave plates are respectively connected to the corresponding second plate and the corresponding third plate, the at least one concave plate is provided with the at least one inclined hole group, each of the inclined hole groups comprises a first group of inclined holes and a second group of inclined holes, each of the first group of inclined holes and the corresponding second group of inclined holes are arranged side by side through the corresponding concave plate, and each of the first group of inclined holes and each of the second group of inclined holes are respectively provided with two inclined holes along an assembly direction. Each of the storage layers comprises a shelf rack and a plurality of fasteners, wherein the fasteners are arranged on left and right sides of the shelf rack, and the fasteners are respectively fastened to the corresponding inclined holes to fix the storage layers between the post components. The shelf boards are respectively arranged on the corresponding storage layer.

In one embodiment, each of the concave plates comprises a recess, a first plate portion, and a second plate portion, two sides of each of the recesses are connected to the corresponding first plate portion and the second plate portion, each of the first plate portions is connected to the corresponding second plate, and each of the second plate portions is connected to the corresponding third plate.

In one embodiment, each of the inclined holes has an inclined angle relative to the adjacent first plate portion or the second plate portion respectively.

In one embodiment, each of the first plate portions comprises an inclined angle relative to the adjacent second plate.

In one embodiment, each of the second plate portions comprises an inclined angle relative to the adjacent third plate.

In one embodiment, along the assembly direction, the recess comprises an inclined angle relative to a front end of the concave square tube.

In one embodiment, the fasteners are respectively divided into a first fastener and a second fastener, each of the storage layers comprises two first assemblies and two second assemblies, each of the first assemblies is provided with the first fasteners, and each of the second assemblies is provided with the second fasteners.

In one embodiment, each of the first assemblies is a Z-shaped hook structure, the first fasteners are fasteners of the Z-shaped hook structure, each of the second assemblies is an L-shaped hook structure, and each of the second fasteners is a fastener of the L-shaped hook structure.

In one embodiment, when the number of the at least one concave plate is multiple, each of the concave plates is provided with one of the inclined hole group; when the number of the at least one concave plate is one, the concave plate is provided with a plurality of inclined hole groups.

Based on the foregoing, in the concave square tube storage shelf of the present disclosure, the assembly structure is simple and relatively stable, thereby improving the overall convenience of use.

Moreover, the square tube of the present disclosure is changed into a concave square tube to increase the structural strength.

A detailed description is given in the following embodiments with reference to the accompanying drawings, in order to make the disclosure more comprehensible.

DETAILED DESCRIPTION

The following embodiments are set forth in detail with accompanying drawings, but the embodiments provided are not intended to limit the scope of the disclosure. In addition, the drawings are for illustrative purposes only and are not drawn to original size. To facilitate understanding, the same components will be identified with the same symbols in the following description.

The terms "including", "comprising", "having", etc. mentioned in the disclosure are open terms, which means "including but not limited to".

In the description of each embodiment, when describing the elements by the terms "first," "second," "third," "fourth," and the like, it is used only to distinguish these components from one another and does not limit the order or importance of these components.

In the description of each embodiment, the so-called "component" may refer to a single part or element constituting a larger system, device or structure. These components can be independent or can collaborate with other components to complete specific functions. Components have different specific meanings in different fields, but generally refer to a basic unit that makes up the whole.

In the description of each embodiment, the so-called "square tube" refers to a tube with a square cross-section. In addition, the so-called "concave square tube" refers to a tube with at least one plate having a concave structure.

In the description of each embodiment, the so-called "hollow tube" refers to a circular or other shaped tubular structure having a cavity inside and a certain thickness outside. Hollow tubes are different from solid tubes in that the inside of hollow tubes is empty, which can reduce weight, save materials and provide higher space efficiency.

In the description of each embodiment, the so-called "recessed portion" refers to a region or a local portion of a surface that is lower in depth than other surrounding portions and is concave or sunken.

In the description of each embodiment, the so-called "stacking direction" refers to the way or order in which objects are stacked and arranged, and usually refers to the relative position and arrangement direction of objects in space.

In the description of each embodiment, the so-called "assembly direction" refers to the direction in which components, parts or elements are connected or arranged in a certain way or sequence during the assembly process, and describes how to assemble each part at a specific angle, position or sequence.

In the description of each embodiment, the so-called "lifting direction" refers to the movement in the vertical direction, which corresponds to the movement in the horizontal direction, such as the moving direction of an object along the vertical axis, including the upward (rising) or downward (falling) motion of an object.

Figure 1:
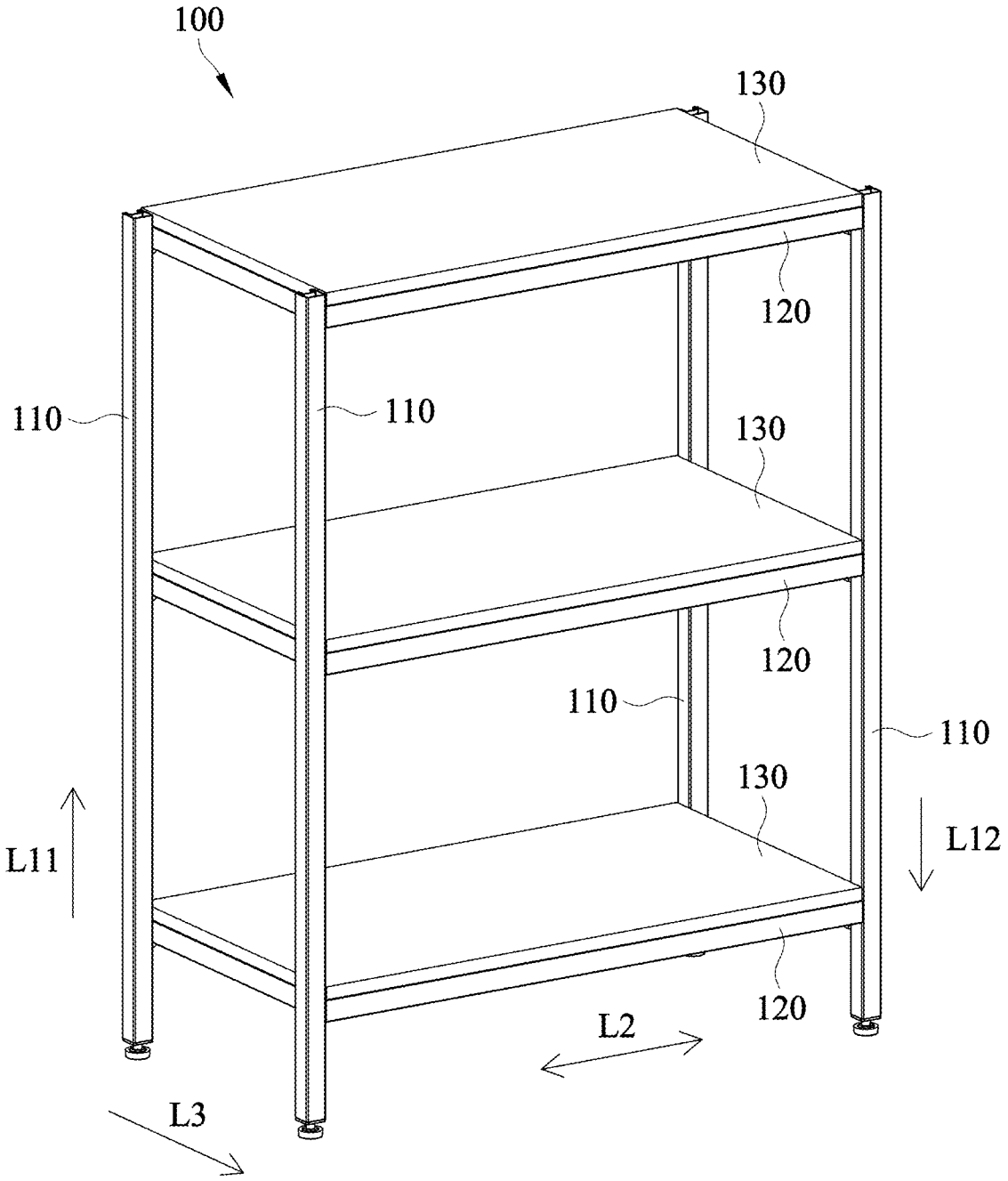
FIG. 1 is a three-dimensional schematic diagram of an embodiment of the concave square tube storage shelf according to the present disclosure.
Figure 2:
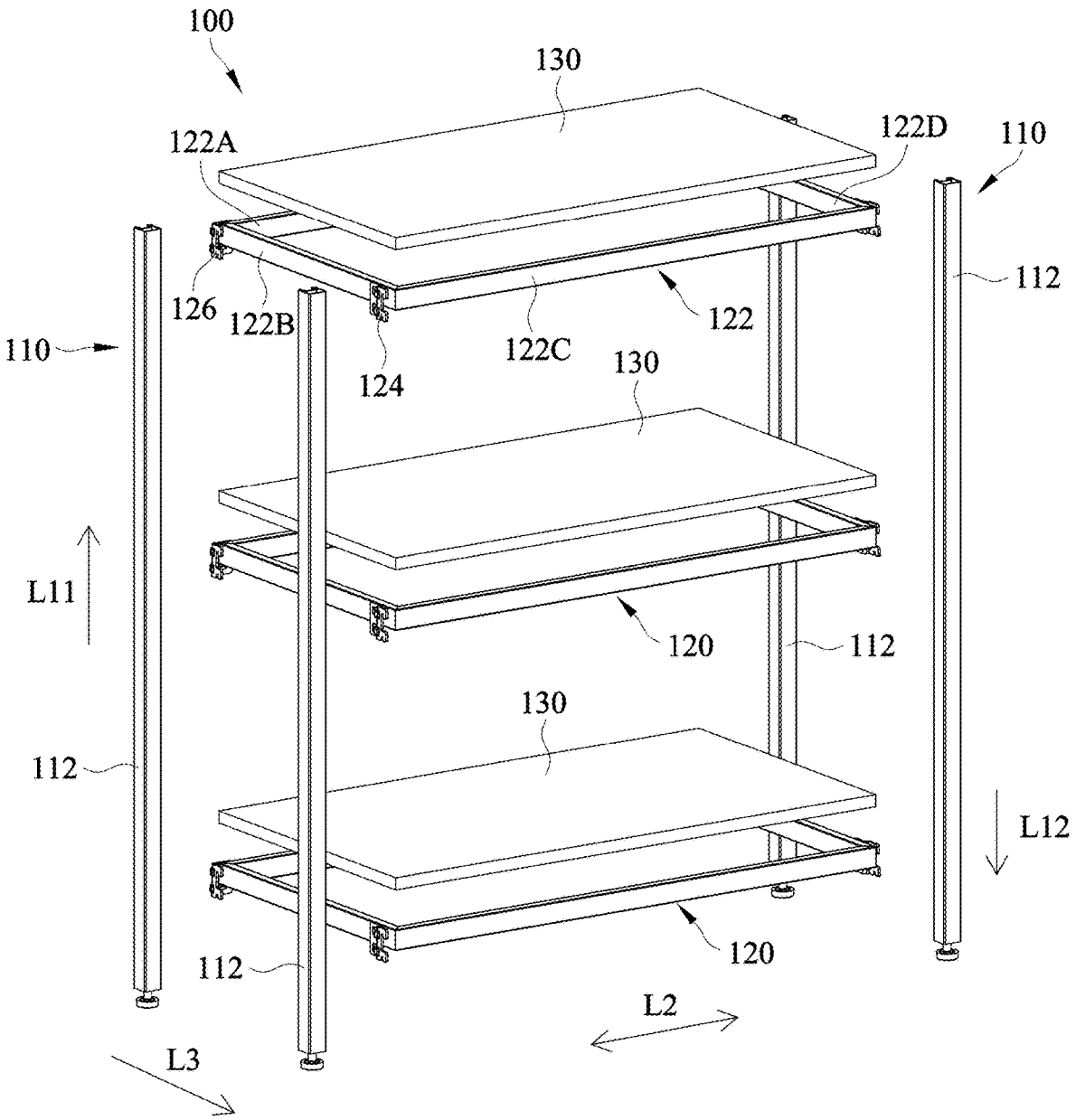
FIG. 2 is an exploded view of an embodiment of a concave square tube storage shelf according to the present disclosure.

FIG. 1 is a three-dimensional schematic diagram of an embodiment of the concave square tube storage shelf according to the present disclosure. FIG. 2 is an exploded view of an embodiment of a concave square tube storage shelf according to the present disclosure. Please refer to FIG. 1 and FIG. 2. The concave square tube storage shelf 100 of the present disclosure includes a plurality of post components 110, three storage layer 120, and three shelf boards 130. The number of the storage layer 120 and the shelf board 130 can be multiple, and the shelf board 130 can be a flat plate. FIG. 1 shows a total of four post components 110. The two post components 110 at the front are spaced apart by a distance, the two post components 110 at the rear are also spaced apart by a distance, and the two post components 110 at the front and rear are also spaced apart by a distance. These post components 110 are arranged in a rectangular shape or an arbitrary shape. The shelf board 130 is disposed on the corresponding storage layer 120, and the three storage layers 120 and the shelf board 130 connected thereto are sequentially arranged between the post components 110 along the stacking direction L11, and can form a variety of different combinations of concave square tube storage shelves 100.

Figure 3A:
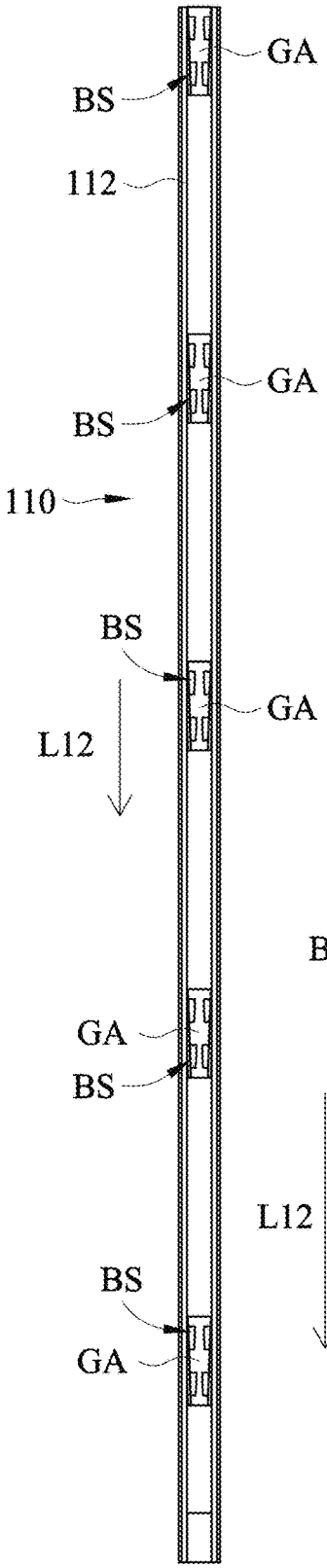
FIG. 3A is a schematic diagram of a post component from one perspective according to the present disclosure.
Figure 3B:
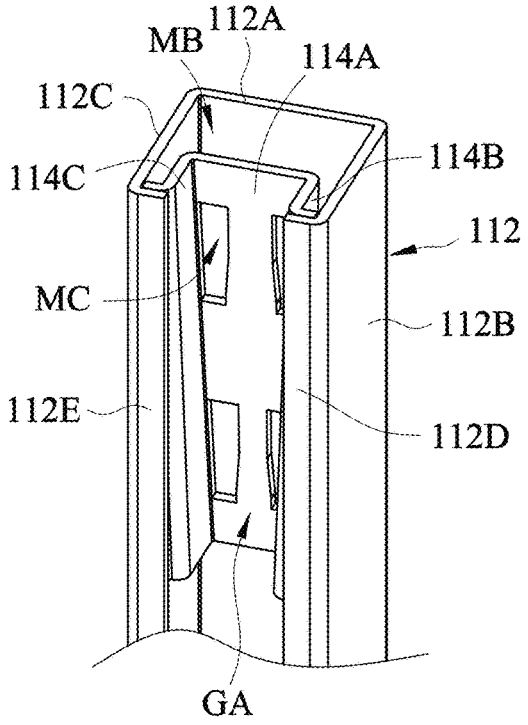
FIG. 3B is a partial three-dimensional schematic diagram of a concave square tube according to the present disclosure.
Figure 3C:
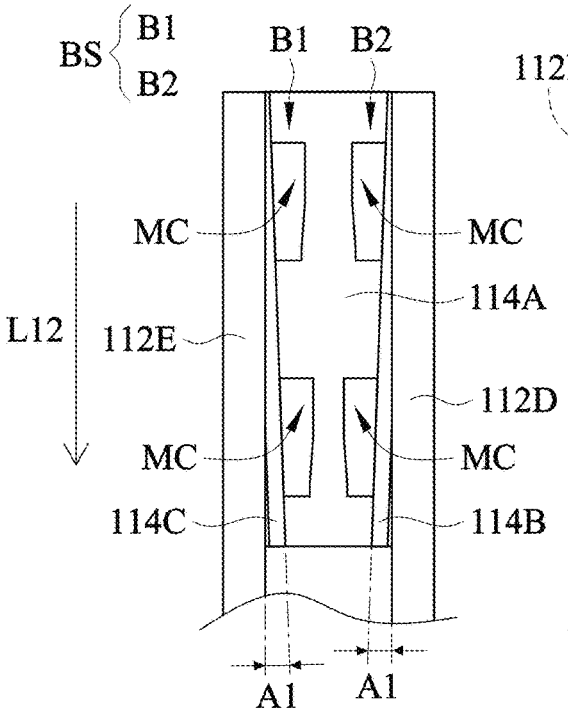
FIG. 3C is a partial schematic diagram of a concave square tube according to the present disclosure.
Figure 3D:
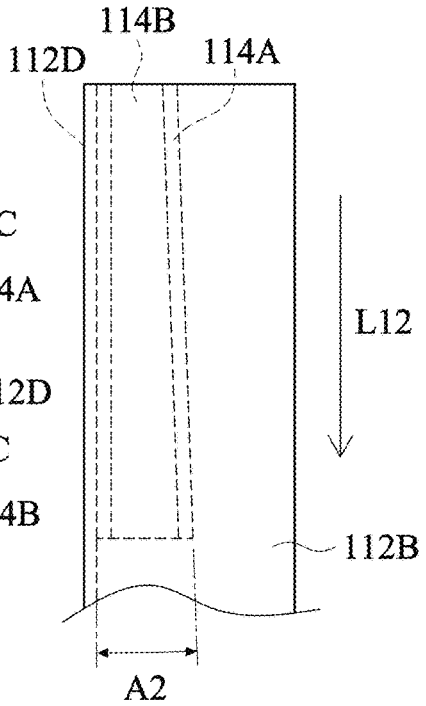
FIG. 3D is a partial side view of a concave square tube according to the present disclosure.

FIG. 3A is a schematic diagram of a post component from one perspective according to the present disclosure. FIG. 3B is a partial three-dimensional schematic diagram of a concave square tube according to the present disclosure. FIG. 3C is a partial schematic diagram of a concave square tube according to the present disclosure. FIG. 3D is a partial side view of a concave square tube according to the present disclosure. Please refer to FIG. 2 to FIG. 3D. The post component 110 of the present disclosure includes a concave square tube 112 and a plurality of inclined holes MC. The concave square tube 112 is a concave square tube structure composed of a first plate 112A, a second plate 112B, a third plate 112C, and a plurality of concave plates GA. The present disclosure changes the square tube into the concave square tube 112 to increase the structural strength of the post components 110.

Both sides of the first plate 112A connect the second plate 112B and the third plate 112C, the second plate 112B is parallel to the third plate 112C, to form a three-sided structure. The second plate 112B extends and bends into a connecting plate 112D, and the third plate 112C extends and bends into another connecting plate 112D. The two sides of several concave plates GA connect the connecting plate 112D of the second plate 112B and the connecting plate 112E of the third plate 112C, so that the first plate 112A, the second plate 112B, the third plate 112C, and several concave plates GA are connected to form a three-dimensional concave structure. The second plate 112B and the third plate 112C are on the opposite sides, and the concave plate GA and the first plate 112A are on the opposite sides. The concave square tube 112 has a hollow portion MB inside as a hollow tube, and is associated with several concave plates GA to strengthen the overall structural strength of concave square tube 112, to withstand external stress and loads. Taking FIG. 3A as an example, the number of the concave plate GA is five. The number of the concave plate GA can be adjusted according to actual conditions.

In one embodiment, the concave plate GA includes a recess 114A, a first plate portion 114B, and a second plate portion 114C. Both sides of the recess 114A are connected to the first plate portion 114B and the second plate portion 114C. The first plate portion 114B is connected to the connecting plate 112D of the second plate 112B, and the second plate portion 114C is connected to the connecting plate 112E of the third plate 112C. The recess 114A can be a recessed portion of the concave plate GA.

In one embodiment, the concave plate GA has three-sided slopes. That is, the first plate portion 114B, the second plate portion 114C and the recess 114A are respectively an inclined structure. Taking FIG. 3C as an example, the first plate portion 114B has an inclined angle A1 relative to the connecting plate 112D of the adjacent second plate 112B. Similarly, the second plate portion 114C has an inclined angle A1 relative to the connecting plate 112E of the adjacent third plate 112C. In addition, along an assembly direction L12, the inclined angle A1 becomes larger. As shown in FIG. 1, the assembly direction L12 is opposite to the stacking direction L11.

As shown in FIG. 3A, there are multiple concave plates GA. Each concave plate GA is provided with an inclined hole group BS. For example, an inclined hole group BS is arranged on the recess 114A in the concave plate GA. The inclined hole group BS has two groups of inclined holes, namely a first group of inclined holes B1 and a second group of inclined holes B2. The first group of inclined holes B1 and the second group of inclined holes B2 are arranged side by side through the recess 114A in the concave plate GA. The first group of inclined holes B1 and the second group of inclined holes B2 are respectively provided with two inclined holes MC along an assembly direction L12, so that the inclined hole group BS on the concave plate GA of this embodiment has four inclined holes MC.

In one embodiment, the inclined structure of the first plate portion 114B and the second plate portion 114C can cover a portion of the location of the inclined hole MC, so that the inclined hole MC has an inclined structure. In other embodiments, the inclined hole can be arranged to have an inclined angle relative to the first plate portion or the second plate portion. That is, the inclined hole itself is an angled hole or slanted hole. The angled hole refers to the inclined holes MC whose length direction is not parallel to the surface of the first plate portion 114B or the second plate portion 114C, but is slanted at a certain angle.

On the other hand, taking FIG. 3D as an example, along the assembly direction L12, the recess 114A has an inclined angle A2 relative to the front end of the concave square tube 112 (such as the connecting plate 112D of the second plate 112B). Along the assembly direction L12, the inclined angle A2 becomes larger.

Figure 4A:
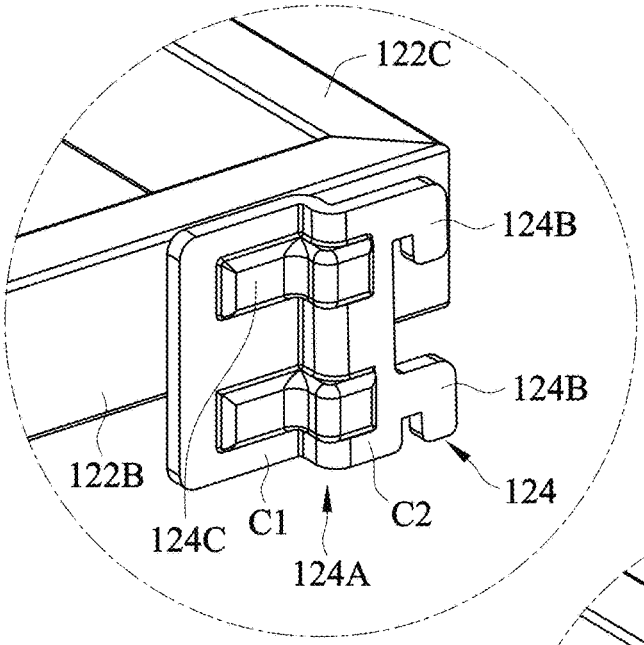
FIG. 4A is a partial perspective view of a first assembly combined with a shelf rack according to the present disclosure.
Figure 4B:
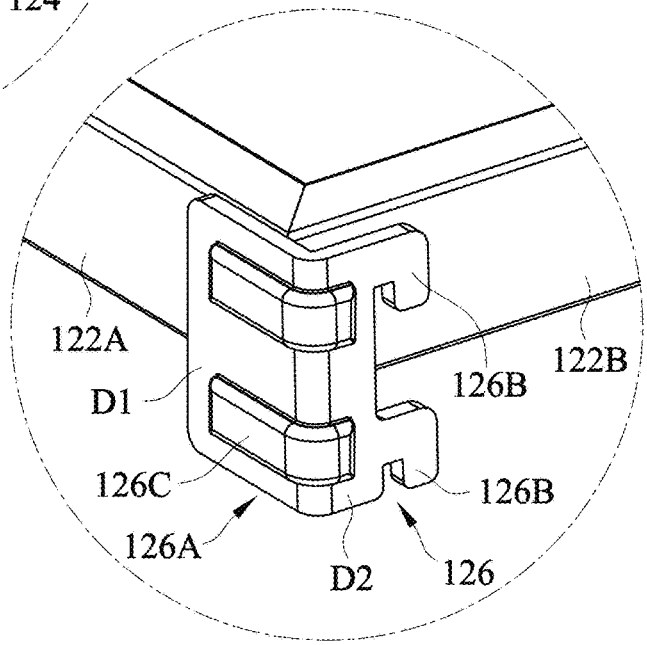
FIG. 4B is a partial perspective view of a second assembly combined with a shelf rack according to the present disclosure.
Figure 4C:
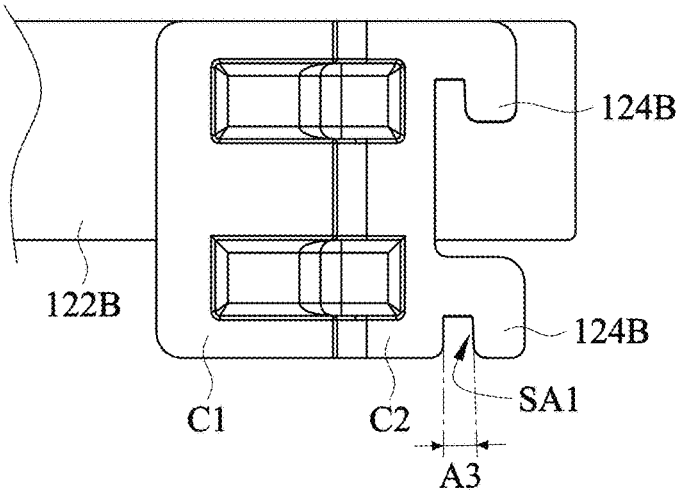
FIG. 4C is a partial side view of a first assembly combined with a shelf rack according to the present disclosure.
Figure 4D:
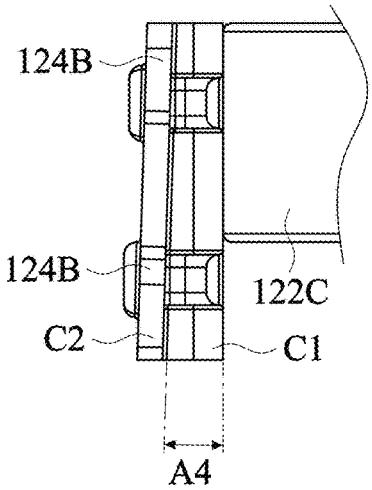
FIG. 4D is a partial schematic diagram of the side surface of the first assembly combined with the shelf rack from another angle according to the present disclosure.

FIG. 4A is a partial perspective view of a first assembly combined with a shelf rack according to the present disclosure. FIG. 4B is a partial perspective view of a second assembly combined with a shelf rack according to the present disclosure. FIG. 4C is a partial side view of a first assembly combined with a shelf rack according to the present disclosure. FIG. 4D is a partial schematic diagram of the side surface of the first assembly combined with the shelf rack from another angle according to the present disclosure. Please refer to FIG. 2 and FIG. 4A to FIG. 4D. The storage layer 120 the present disclosure includes a shelf rack 122, two first assemblies 124, and two second assemblies 126. The shelf rack 122 is an elongated frame, which includes a first cross member 122A, a second cross member 122B, a third cross member 122C, and a fourth cross member 122D. The extension direction of the first cross member 122A is parallel to the extension direction of the third cross member 122C. The first cross member 122A and the third cross member 122C are separated by a distance. The extension direction of the second cross member 122B is parallel to the extension direction of the fourth cross member 122D. The second cross member 122B and the fourth cross member 122D are separated by a distance. The two ends of the first cross member 122A are connected to the second cross member 122B and the fourth cross member 122D, and the two ends of the third cross member 122C are connected to the second cross member 122B and the fourth cross member 122D to form a long frame as shown in FIG. 2. The left and right sides of the shelf rack 122 are the second cross member 122B and the fourth cross member 122D respectively, and the front and rear sides of the shelf rack 122 are the third cross member 122C and the first cross member 122A respectively.

In this embodiment, the two first assemblies 124 and the two second assemblies 126 are respectively disposed at positions of the cross members corresponding to the shelf rack 122. In addition, the first fastener 124B of the first assembly 124 and the second fastener 126B of the second assembly 126 are located at the left and right sides of the shelf rack 122. For example, the second cross member 122B and the fourth cross member 122D are provided with a first assembly 124. Two opposite ends of the first cross member 122A are respectively provided with a second assembly 126. One side of the second assembly 126 is disposed on the first cross member 122A, and the second fastener 126B of the second assembly 126 spans and is located on the outer side of the second cross member 122B. Since the left and right sides of the shelf rack 122 are the second cross member 122B and the fourth cross member 122D respectively, the second fastener 126B of the second assembly 126 also spans and is located outside the fourth cross member 122D.

The first assembly 124 of the embodiment includes a first body 124A, two first fasteners 124B, and at least one convex rib 124C. The first body 124A is a Z-shaped hook structure, and the first fastener 124B is a fastener of the Z-shaped hook structure. The convex rib 124C can be disposed on the outer surface of the first body 124A, so as to enhance the strength of the first assembly 124. The first body 124A includes a first fixture C1 and a fastener connecting piece C2. The first fixture C1 is a plate body. The first fixture C1 is fixed to the surface of the second cross member 122B in the shelf rack 122 to set the first assembly 124 on the second cross member 122B. Similarly, the first fixture can be fixed to the outer surface of the fourth cross member in the shelf rack to set the first assembly 124 on the fourth cross member 122D.

The fastener connecting piece C2 is connected between the two first fasteners 124B and the first fixture C1. The fastener connecting piece C2 is a plate body bent from one side of the first fixture C1. The two first fasteners 124B are respectively connected to different positions of the fastener connecting piece C2. Accordingly, the two first fasteners 124B are spaced apart from the surface of the second cross member 122B by a distance. That is, the two first fasteners 124B do not contact or combine with the surface of the second cross member 122B.

In one embodiment, the inner side surface of the first fastener 124B is an inclined surface SA1. That is, the fastener of the present disclosure has an inclined surface and thus has a sloped structure. The inclined surface SA1 of the first fastener 124B has a fastener inclined angle A3 relative to the fastener connecting piece C2. In addition, taking FIG. 4D as an example, the fastener connecting piece C2 has a fastener structure inclined angle A4 relative to the first fixture C1. That is, the fastener connecting piece C2 has a sloped structure. Since the fastener connecting piece C2 connects the two first fasteners 124B, the two first fasteners 124B also have a fastener structure inclined angle A4 with the fastener connecting piece C2.

The second assembly 126 of this embodiment includes a second body 126A, two second fasteners 126B, and at least one convex rib 126C. The second body 126A is an L-shaped hook structure, and the second fastener 126B is a fastener of the L-shaped hook structure. The convex rib 126C can be arranged on the outer surface of the second body 126A, so as to enhance the strength of the second assembly 126. The second body 126A includes a second fixture D1 and a fastener connecting piece D2. The second fixture D1 is a plate body, and the second fixture D1 is fixed to the surface of the first cross member 122A in the shelf rack 122, so as to place the second assembly 126 on the first cross member 122A.

The fastener connecting piece D2 is connected between the two second fasteners 126B and the second fixture D1. The fastener connecting piece D2 is a plate body bent from one side of the second fixture D1. The two second fasteners 126B are respectively connected to different positions of the fastener connecting piece D2. Accordingly, the two second fasteners 126B are spaced apart from the surface of the second cross member 122B at a distance. That is, the two second fasteners 126B are not in contact with or combined with the surface of the second cross member 122B.

The structure of the second fastener 126B is similar to that of the first fastener 124B. Therefore, the inner side surface of the first fastener 124B in FIG. 4C is an inclined surface SA1, and the fastener connecting piece C2 in FIG. 4D has a fastener structure inclined angle A4 relative to the first fixture C1, which are both applicable to the structure of the second fastener 126B.

Based on the foregoing, the fastener of the storage layer 120 of the present disclosure are arranged on the shelf rack 122. The fastener are divided into the types of first fastener 124B and second fastener 126B. The first assembly 124 is provided with the first fastener 124B, and the second assembly 126 is provided with the second fastener 126B. The number and setting configuration of the fastener can be adjusted according to actual conditions.

Figure 5:
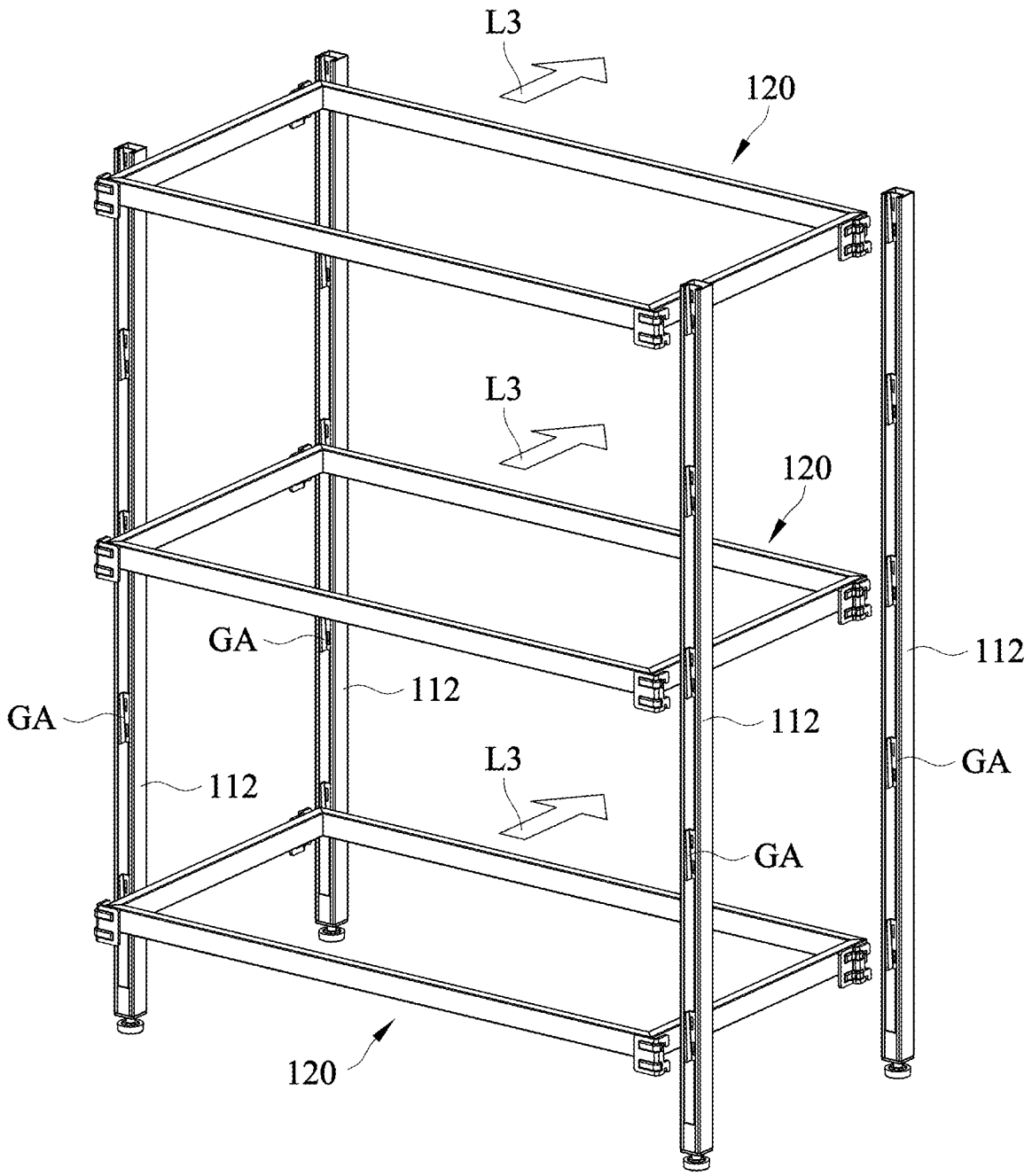
FIG. 5 is a three-dimensional schematic diagram of a process of installing a storage layer to a post component according to the present disclosure.
Figure 6:
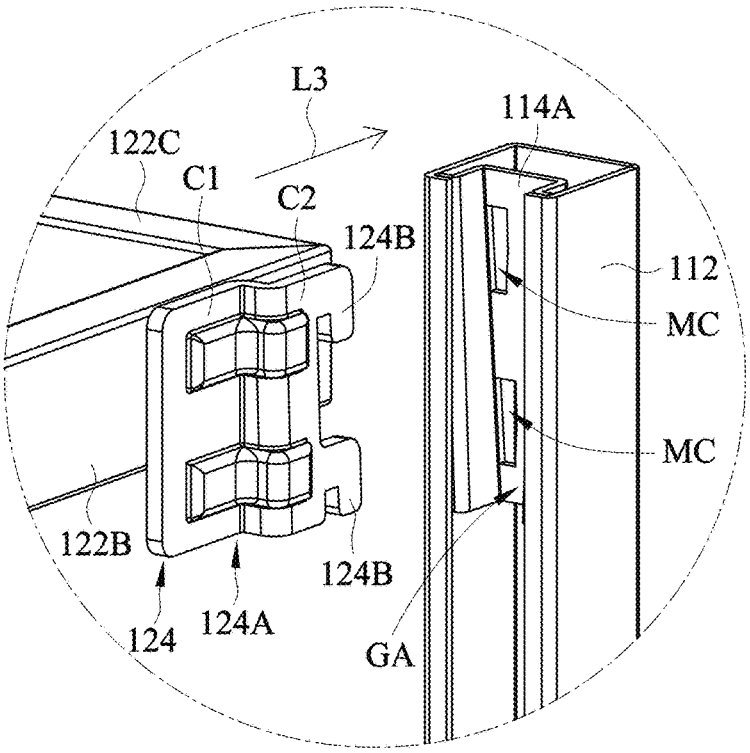
FIG. 6 to FIG. 7 are three-dimensional schematic diagrams respectively illustrating a process of assembling the first assembly into the inclined hole according to the present disclosure.
Figure 7:
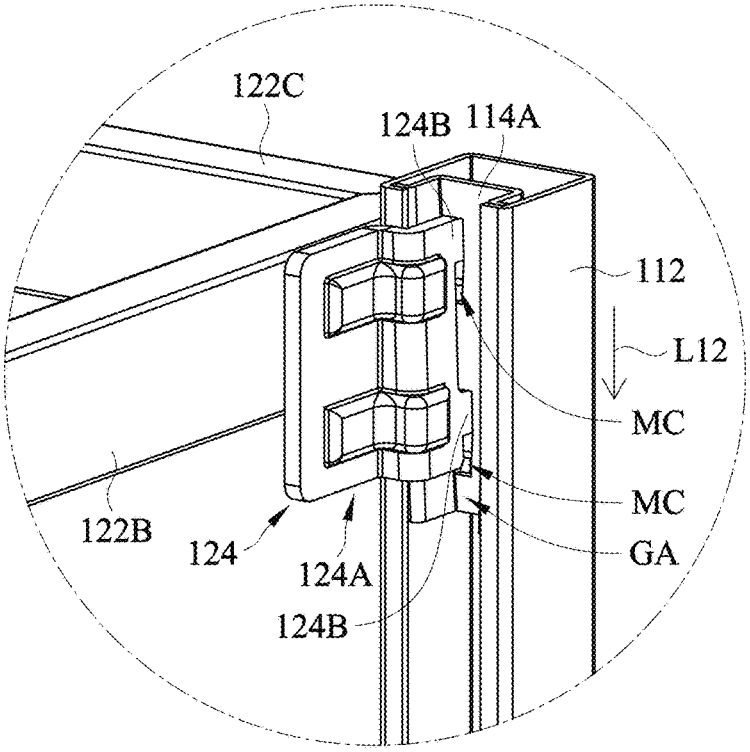
Figure 8:
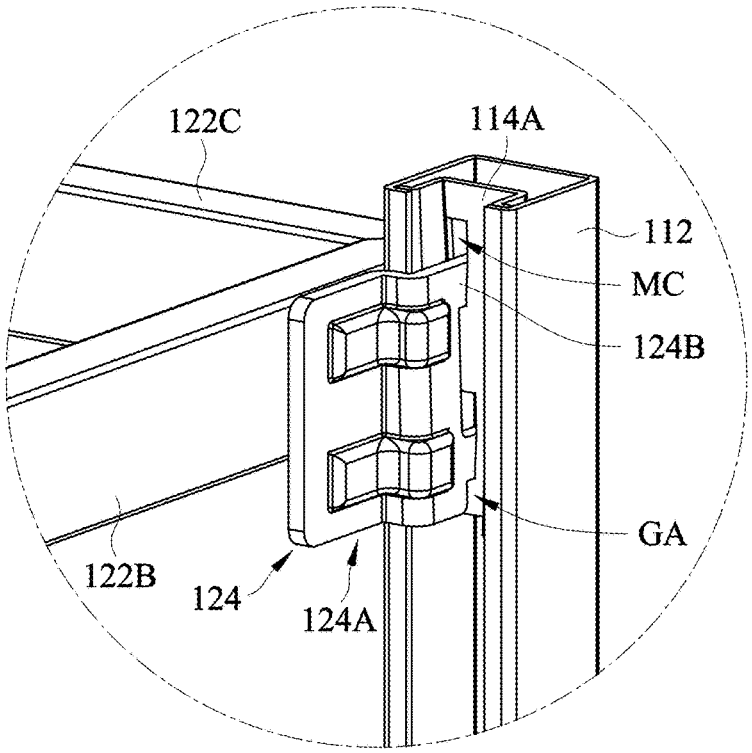
FIG. 8 is a three-dimensional schematic diagram of the first assembly being engaged with the inclined hole according to the present disclosure.

FIG. 5 is a three-dimensional schematic diagram of a process of installing a storage layer to a post component according to the present disclosure. FIG. 6 to FIG. 7 are three-dimensional schematic diagram respectively illustrating a process of assembling the first assembly into the inclined hole according to the present disclosure. FIG. 8 is a three-dimensional schematic diagram of the first assembly being engaged with the inclined hole according to the present disclosure.

Please refer to FIG. 5. In this embodiment, a process of assembling the storage layer 120 on the four post components 110 is illustrated. First, the storage layer 120 is moved in a moving direction L3. The moving direction L3 is a horizontal movement, or a movement in the direction facing and toward the concave plate GA of the concave square tube 112.

Afterwards, as shown in FIGS. 6 to 7, the two first fasteners 124B in the first assembly 124 move toward the direction of the concave plate GA of the concave square tube 112. Accordingly, the two first fasteners 124B gradually approach the positions of the two inclined holes MC until the two first fasteners 124B are located inside the corresponding inclined holes MC.

Next, the storage layer 120 continues to move along the assembly direction L12. That is, the two first fasteners 124B move toward the bottom of the inclined holes MC until the two first fasteners 124B are engaged with the inclined holes MC on the left side of the concave plate GA as shown in FIG. 8, so as to fix the first assembly 124 in the storage layer 120 to the concave square tube 112 in the post components 110.

In addition, as shown in FIG. 4D of the present disclosure, the fastener connecting piece C2 has a fastener structure inclined angle A4 relative to the first fixture C1. Along the assembly direction L12, the inclination structure of the fastener connecting piece C2 can cooperate with the inclination structure of the inclined holes MC for matching and fastening.

Furthermore, as shown in FIG. 4C, the inner side surface of the first fastener 124B is an inclined surface SA1. The first fastener 124B itself has an inclined structure. The inclined structure of the first fastener 124B is inserted into the inclined hole MC for matching and fastening, thereby increasing stability.

At the same time, the two second fasteners 126B in the second assembly 126 of FIG. 4B can be described by referring to the aforementioned first fastener 124B. Accordingly, the two second fasteners 126B are fastened to the inclined holes MC on the left side of the concave plate GA, so as to fix the second assembly 126 in the storage layer 120 to the concave square tube 112 in the post components 110.

As such, the fasteners (such as the first fastener 124B and the second fastener 126B) of the storage layer 120 of the present disclosure are fastened to the inclined holes MC of the concave plate GA, so as to fix the storage layer 120 between the four post components 110 as shown in FIG. 1. Afterwards, the shelf board 130 is placed and disposed on the storage layer 120, and the shelf board 130 is located between the post components 110.

Next, the storage layer 120 and the shelf board 130 are sequentially disposed between the post components 110 along the stacking direction L11, to form the concave square tube storage shelf 100 as shown in FIG. 1.

In addition, due to the concave plates GA at different positions in the concave square tube 112, the storage layer 120 is moved to release the fastening relationship between the fastener of the storage layer 120 (for example, the first fastener 124B and the second fastener 126B) and the inclined holes MC of the concave plate GA. In addition, the fastener of the storage layer 120 (for example, the first fastener 124B and the second fastener 126B) can be fastened to the inclined holes MC of the concave plate GA at different positions according to the situation, in order to adjust and lift the storage layer 120.

Figure 9:
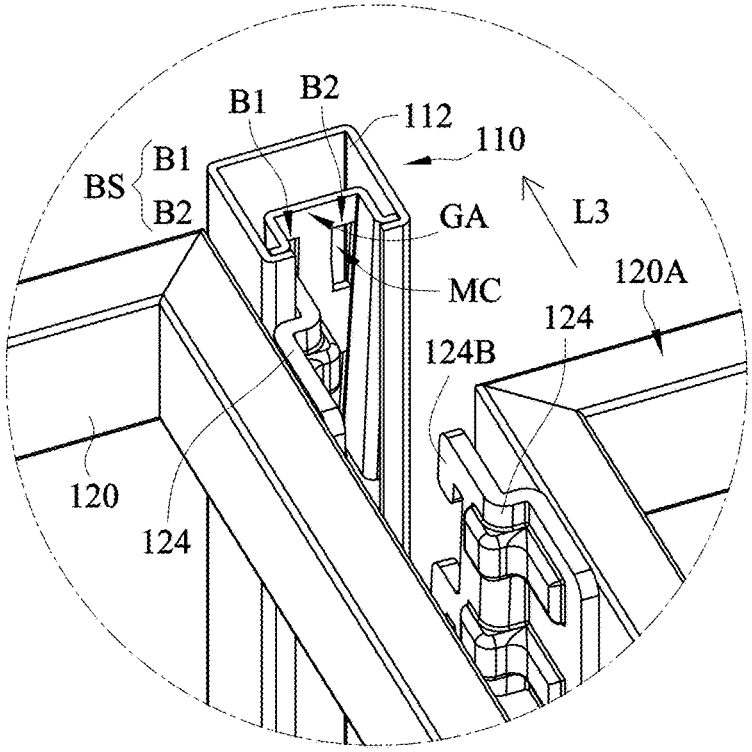
FIG. 9 is a three-dimensional schematic diagram of an embodiment illustrating a process of assembling two storage layers into a concave square tube according to the present disclosure.
Figure 10:
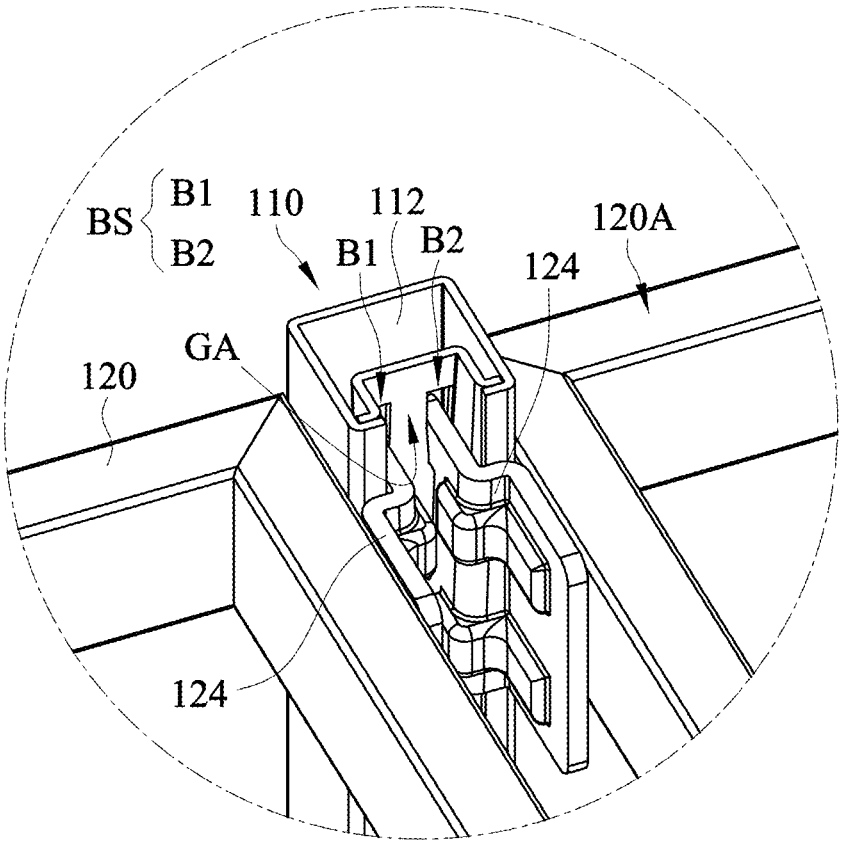
FIG. 10 is a three-dimensional schematic diagram of an embodiment illustrating a process of fastening the inclined holes in the post components according to the present disclosure.

FIG. 9 is a three-dimensional schematic diagram of an embodiment illustrating a process of assembling two storage layers into a concave square tube according to the present disclosure. FIG. 10 is a three-dimensional schematic diagram of an embodiment illustrating a process of fastening the inclined holes in the post components according to the present disclosure. Please refer to FIGS. 3A, 9 and 10 first. Each concave plate GA has an inclined hole group BS, and the inclined hole group BS has two groups of inclined holes inclined holes side by side, namely a first group of inclined holes B1 and a second group of inclined holes B2. The first group of inclined holes B1 and the second group of inclined holes B2 are respectively provided with two inclined holes MC along the assembly direction L12, so that the inclined hole group BS on the concave plate GA of this embodiment has four inclined holes MC. Accordingly, the left side of the concave square tube 112 has the first group of inclined holes B1 for assembling a storage layer 120, and the right side of the same concave square tube 112 has the second group of inclined holes B2 for assembling another storage layer 120A. That is, adjacent storage layers 120 and 120A can share a concave square tube 112, so that the storage layers 120 and 120A can be combined and arranged side by side, so as to be beautiful and cost effective.

In addition, take the first assembly 124 as an example. In other embodiments, the second assembly 126 shown in FIG. 4B can also be engaged with the corresponding inclined hole MC using the above method. Accordingly, adjacent storage layers 120 and 120A can share a concave square tube 112, so that the storage layers 120 and 120A can be arranged side by side.

Figure 11:
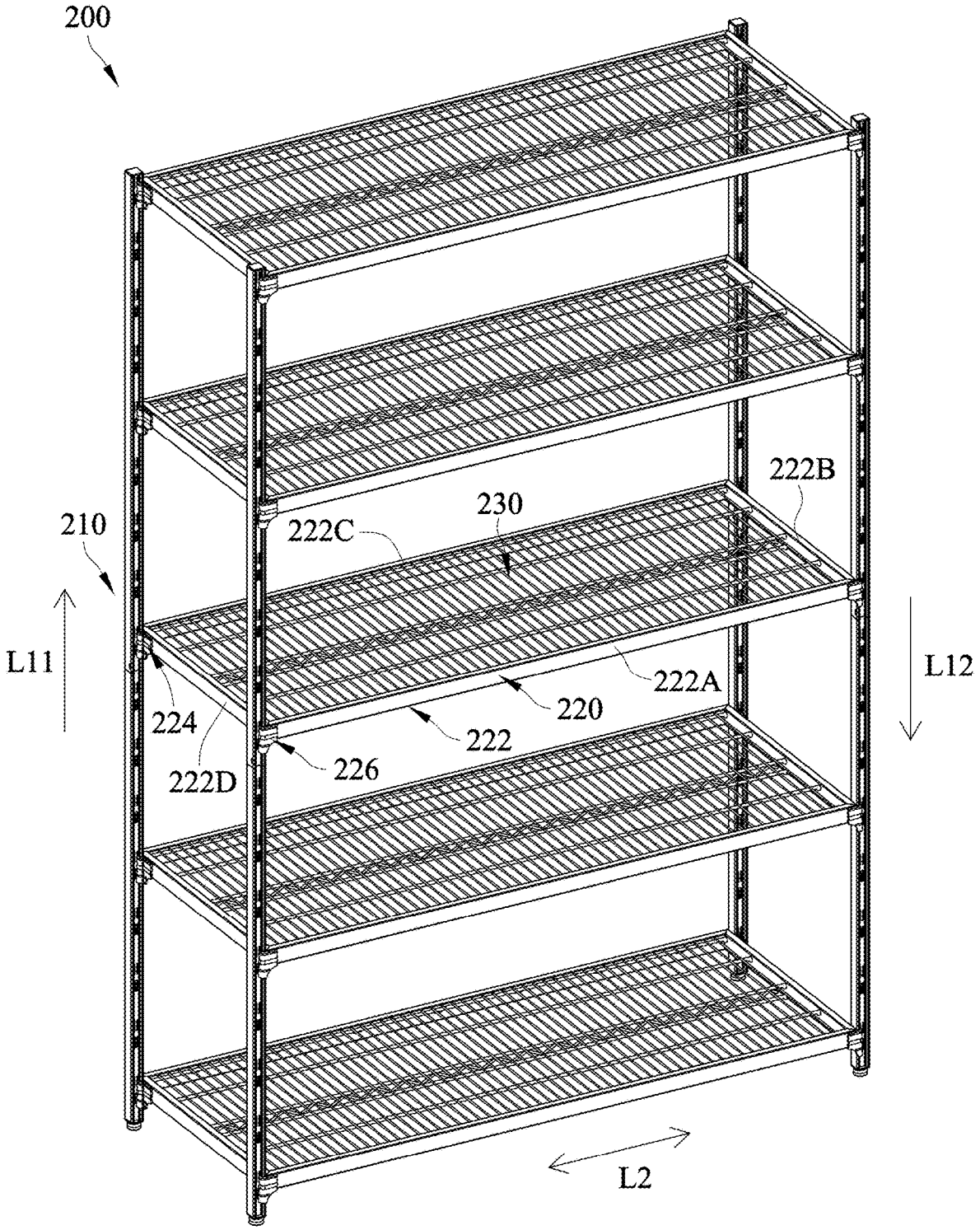
FIG. 11 is a three-dimensional schematic diagram of another embodiment of the concave square tube storage shelf according to the present disclosure.

FIG. 11 is a three-dimensional schematic diagram of another embodiment of the concave square tube storage shelf according to the present disclosure. Please refer to FIG. 11. The concave square tube storage shelf 200 the present disclosure includes a plurality of post components 210, five storage layers 220, and five shelf boards 230. The number of the storage layer 220 and the shelf board 230 can be multiple, and the shelf board 230 can be a grid. FIG. 11 shows a total of four post components 210. The two post components 210 at the front are spaced apart by a distance, the two post components 210 at the rear are spaced apart by a distance, and the two post components 210 at the front and rear are also spaced apart by a distance. These post components 210 are arranged in a rectangular shape or an arbitrary shape. The shelf board 230 are disposed on the corresponding storage layer 220. The five storage layers 220 and the shelf board 230 connected thereto are sequentially arranged between the post components 210 along the stacking direction L11, and can form a variety of different combinations of concave square tube storage shelves 200.

Figure 12:
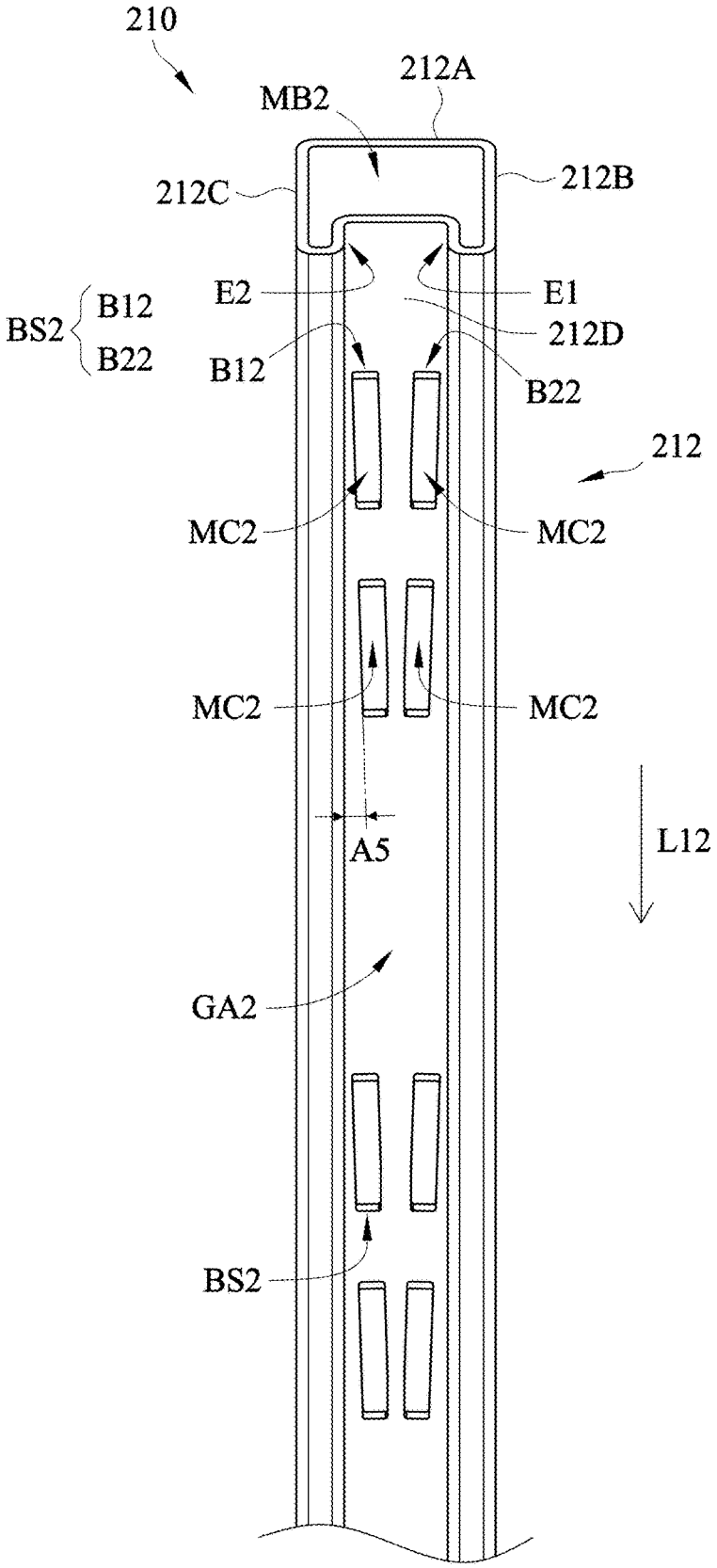
FIG. 12 is a partial three-dimensional schematic diagram of the concave square tube in FIG. 11 of the present disclosure.

FIG. 12 is a partial three-dimensional schematic diagram of the concave square tube in FIG. 11 of the present disclosure. Please refer to FIG. 11 and FIG. 12. The post component 210 of the present disclosure includes a concave square tube 212 and a plurality of inclined holes MC2. The concave square tube 212 is a concave square tube structure composed of a first plate 212A, a second plate 212B, a third plate 212C, and a concave plate GA2. The square tube is changed into the concave square tube 212 by the present disclosure to increase the structural strength of the post components 210. It should be noted that the difference between the post component 210 in FIG. 12 and the post component 110 in FIG. 3B is that the number of concave plate GA2 is one. That is, the concave plate GA2 is a single plate, which is different from FIG. 3B where the number of concave plates GA is multiple.

The two sides of the first plate 212A are respectively connected to the second plate 212B and the third plate 212C, and the two sides of the concave plate GA2 are respectively connected to the second plate 212B and the third plate 212C. As such, the first plate 212A, the second plate 212B, the third plate 212C, and the concave plate GA2 are connected to be a three-dimensional concave structure. The second plate 212B and the third plate 212C are on opposite sides, and the concave plate GA2 and the first plate 212A are on opposite sides. The concave square tube 212 has a hollow portion MB2 inside and is a hollow tube in association with the concave plate GA2, so as to enhance the structural strength of the overall concave square tube 212 to withstand external pressure and load.

In one embodiment, the concave plate GA2 includes a recess 212D, a first plate portion E1, and a second plate portion E2. The two sides of the recess 212D are connected to the first plate portion E1 and the second plate portion E2. The first plate portion E1 is connected to the second plate 212B, the second plate portion E2 is connected to the third plate 212C, and the recess 212D can be a recessed portion of the concave plate GA2.

As shown in FIG. 12, the number of the concave plate GA2 is one, and a plurality of inclined hole groups BS2 are arranged on the single concave plate GA2. For example, the recess 212D in the concave plate GA2 is provided with a plurality of inclined hole groups BS2 arranged along the assembly direction L12. The inclined hole group BS2 has two inclined hole groups, namely a first group of inclined holes B12 and a second group of inclined holes B22. The first group of inclined holes B12 and the second group of inclined holes B22 are arranged side by side in the recess 212D in the concave plate GA2. In addition, the first group of inclined holes B12 and the second group of inclined holes B22 are respectively provided with two inclined holes MC2 along the assembly direction L12, so that the inclined hole group BS2 on the concave plate GA2 of this embodiment has four inclined holes MC2.

The inclined holes MC2 has an inclined structure. The inclined hole MC2 has an inclined angle A5 relative to the adjacent plate portion (such as the second plate portion E2 or the first plate portion E1). That is, the inclined hole MC2 itself is a slanted hole, so that the length direction of the inclined hole MC2 is not parallel to the surface of the first plate portion E1 or the second plate portion E2, but is a hole obliquely drilled at a certain angle.

Figure 13:
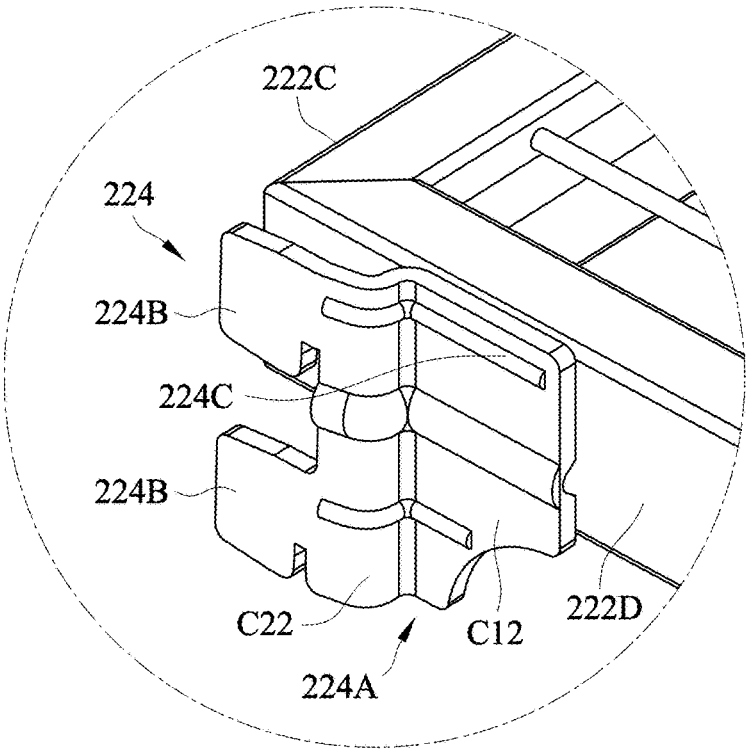
FIG. 13 is a partial perspective view of a first assembly combined with a shelf rack according to the present disclosure.
Figure 14:
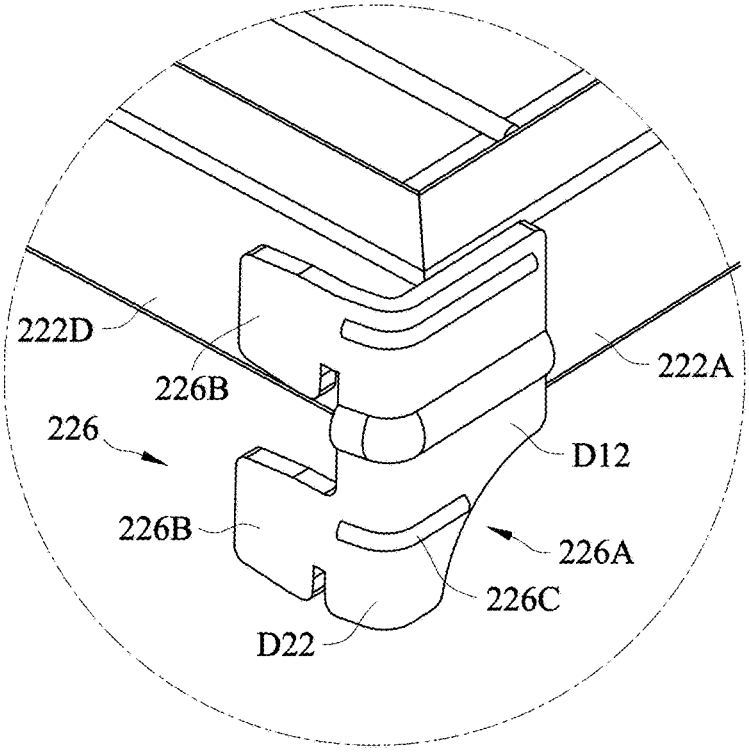
FIG. 14 is a partial perspective view of a second assembly combined with a shelf rack according to the present disclosure.

FIG. 13 is a partial perspective view of a first assembly combined with a shelf rack according to the present disclosure. FIG. 14 is a partial perspective view of a second assembly combined with a shelf rack according to the present disclosure. Please refer to FIGS. 11, 13 and 14. The storage layer 220 of the present disclosure includes a shelf rack 222, two first assemblies 224, and two second assemblies 226. The shelf rack 222 is an elongated frame, which includes a first cross member 222A, a second cross member 222B, a third cross member 222C, and a fourth cross member 222D. The extension direction of the first cross member 222A is parallel to the extension direction of the third cross member 222C, and the first cross member 222A and the third cross member 222C are separated by a distance. The extension direction of the second cross member 222B is parallel to the extension direction of the fourth cross member 222D, and the second cross member 222B and the fourth cross member 222D are separated by a distance. The two ends of the first cross member 222A are connected to the second cross member 222B and the fourth cross member 222D, and the two ends of the third cross member 222C are connected to the second cross member 222B and the fourth cross member 222D, to form a long frame as shown in FIG. 11. The left and right sides of the shelf rack 222 are the second cross member 222B and the fourth cross member 222D respectively, and the front and rear sides of the shelf rack 222 are the third cross member 222C and the first cross member 222A respectively.

In this embodiment, the two first assemblies 224 and the two second assemblies 226 are respectively disposed at positions of the cross members corresponding to the shelf rack 222. Furthermore, the first fastener 224B of the first assembly 224 and the second fastener 226B of the second assembly 226 are located at the left and right sides of the shelf rack 122. For example, the second cross member 222B and the fourth cross member 222D are provided with a first assembly 224, and two opposite ends of the first cross member 222A are respectively provided with a second assembly 226. One side of the second assembly 226 is disposed on the first cross member 222A, and the second fastener 226B of the second assembly 226 spans across and is located at the outer side of the fourth cross member 222D. Since the left and right sides of the shelf rack 222 are the second cross member 222B and the fourth cross member 222D respectively. Therefore, the second fastener 226B of the second assembly 226 also spans and is located at the outer side of the second cross member.

The first assembly 224 of the present embodiment includes a first body 224A, two first fasteners 224B, and at least one convex rib 224C. The first body 224A is a Z-shaped hook structure, and the first fastener 224B is a fastener of the Z-shaped hook structure. The convex rib 224C can be arranged on the outer surface of the first body 224A to enhance the strength of the first assembly 224. The first body 224A includes a first fixture C12 and a fastener connecting piece C22. The first fixture C12 is a plate body. The first fixture C12 is fixed to the surface of the fourth cross member 222D in the shelf rack 222, so as to set the first assembly 224 on the fourth cross member 222D. Similarly, the first fixture can be fixed to the outer surface of the second cross member in the shelf rack, to set the first assembly 224 on the second cross member 222B.

The fastener connecting piece C22 is connected between the two first fasteners 224B and the first fixture C12. The fastener connecting piece C22 is a plate body bent from one side of the first fixture C12. The two first fasteners 224B are respectively connected to different positions of the fastener connecting piece C22, so that the two first fasteners 224B are spaced apart by a distance from the surface of the fourth cross member 222D. That is, the two first fasteners 224B are not in contact with or combined with the surface of the fourth cross member 222D.

The second assembly 226 of this embodiment includes a second body 226A, two second fasteners 226B, and at least one convex rib 226C. The second body 226A is an L-shaped hook structure, and the second fastener 226B is a fastener of the L-shaped hook structure. The convex rib 226C can be arranged on the outer surface of the second body 226A, to enhance the strength of the second assembly 226. The second body 226A includes a second fixture D12 and a fastener connecting piece D22. The second fixture D12 is a plate body, and the second fixture D12 is fixed to the surface of the first cross member 222A in the shelf rack 222, so as to place the second assembly 226 on the first cross member 222A.

The fastener connecting piece D22 is connected between the two second fasteners 226B and the second fixture D12. The fastener connecting piece D22 is a plate body bent from one side of the second fixture D12. The two second fasteners 226B are respectively connected to different positions of the fastener connecting piece D22, so that the two second fasteners 226B are spaced apart by a distance from the surface of the second cross member 222B. That is, the two second fasteners 226B are not in contact with or combined with the surface of the second cross member 222B.

Figure 15:
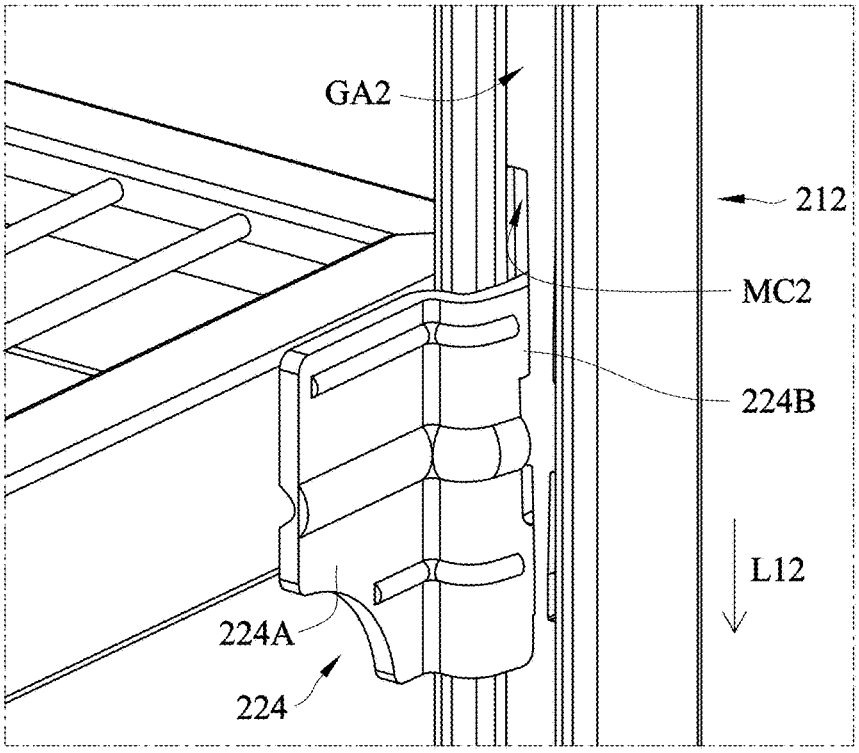
FIG. 15 is a three-dimensional schematic diagram of the first assembly engaged with the inclined hole according to the present disclosure.
Figure 16:
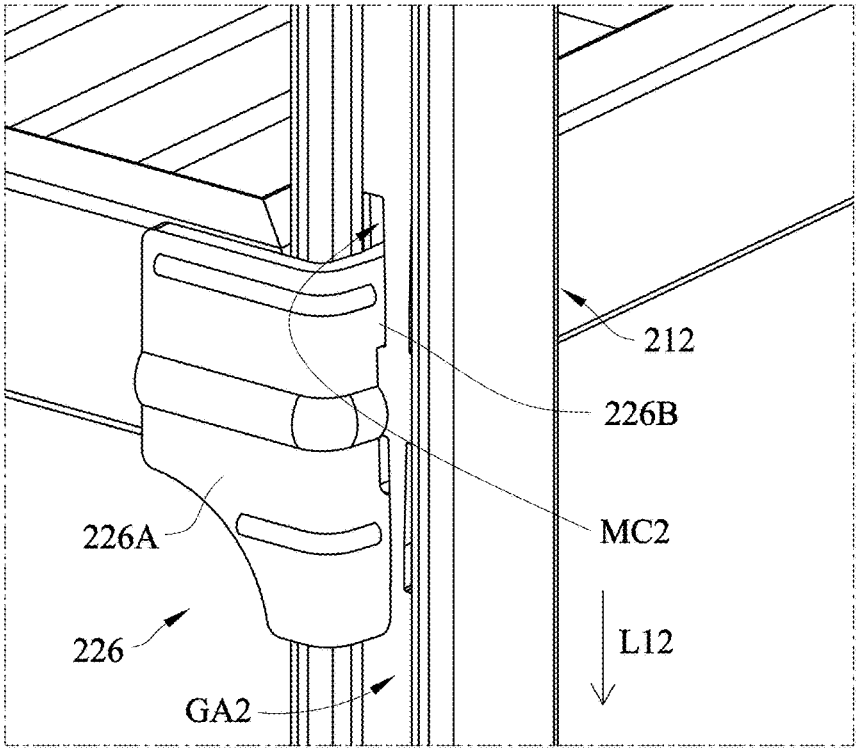
FIG. 16 is a three-dimensional schematic diagram of the second assembly engaged with the inclined hole according to the present disclosure.

FIG. 15 is a three-dimensional schematic diagram of the first assembly engaged with the inclined hole according to the present disclosure. FIG. 16 is a three-dimensional schematic diagram of the second assembly engaged with the inclined hole according to the present disclosure. Please refer to FIGS. 11, 15 and 16. The assembly process of the first fastener 224B of the first fastener 224 and the second fastener 226B of the second assembly 226 of this embodiment is similar to the process shown in FIGS. 5 to 8 above. As such, by engaging the fastener (such as the first fastener 224B and the second fastener 226B) of the storage layer 220 of the present disclosure with the inclined hole MC2 of the concave plate GA2, the storage layer 220 can be fixed between the four post components 210. Afterwards, the shelf board 230 is placed and disposed on the storage layer 220, and the shelf board 230 is located between the post components 210. Next, the storage layer 220 and the shelf board 230 are sequentially disposed between the post components 210 along the stacking direction L11, so as to form a concave square tube storage shelf 200 as shown in FIG. 11.

In addition, in this embodiment of FIG. 12, the concave plate GA2 has a plurality of inclined hole groups BS2. The inclined hole group BS2 has two groups of inclined holes side by side, namely a first group of inclined holes B12 and a second group of inclined holes B22. The first group of inclined holes B12 and the second group of inclined holes B22 are respectively provided with two inclined holes MC2 along the assembly direction L12. Accordingly, the inclined hole group BS2 on the concave plate GA2 of the same concave square tube 212 of this embodiment has four inclined holes MC2, the left side of the same concave square tube 212 has the first group of inclined holes B12, and the right side of the same concave square tube 212 has the second group of inclined holes B22. Therefore, by utilizing the method shown in FIG. 10, the adjacent storage layers can share a concave square tube 212, so that different storage layers can be combined and arranged side by side.

Based on the foregoing, in the concave square tube storage shelf of the present disclosure, the assembly structure is simple and relatively stable, thereby improving the overall convenience of use.

Moreover, the square tube of the present disclosure is changed into a concave square tube to increase the structural strength.

Furthermore, the fastener of one embodiment has an inclined structure, and the inclined structure of the fastener is inserted into the inclined hole for fastening and matching, thereby increasing stability.

In addition, the concave plate of one embodiment has two inclined holes on both sides, so that the left and right sides of the same concave square tube can be assembled with a storage layer respectively. That is, the adjacent storage layers can share a concave square tube, so as to be beautiful and cost effective.

Although the present disclosure has been disclosed in the form of embodiments, they are not intended to limit the present disclosure. Anyone with ordinary knowledge in the relevant technical field may make slight changes and modifications without departing from the spirit and scope of the present disclosure. Therefore, the scope of protection of this disclosure shall be subject to the scope of the appended patent application.

What is claimed is:

1. A concave square tube storage shelf, comprising:

a coupling assembly, including:

a plurality of post components, each comprising a concave square tube and at least one inclined hole group, wherein each of the concave square tubes comprises a first plate, a second plate, a third plate, and at least one concave plate, each of the second plates and the corresponding third plate are parallel to each other, each of the first plates and the at least one concave plate are opposite sides, two sides of each of the first plates are respectively connected to the corresponding second plate and the corresponding third plate, two sides of each of the concave plates are respectively connected to the corresponding second plate and the corresponding third plate, wherein each of the concave plates comprises a recess, a first plate portion, and a second plate portion, two sides of each of the recesses are connected to the corresponding first plate portion and the second plate portion, each of the first plate portions is connected to the corresponding second plate, and each of the second plate portions is connected to the corresponding third plate, and wherein along an assembly direction, the recess comprises an inclined angle relative to a front end of the concave square tube, the at least one concave plate is provided with the at least one inclined hole group, each of the inclined hole groups comprises a first group of inclined holes and a second group of inclined holes, each of the first group of inclined holes and the corresponding second group of inclined holes are arranged side by side through the corresponding concave plate, and each of the first group of inclined holes and each of the second group of inclined holes are respectively provided with two inclined holes along the assembly direction;

a plurality of storage layers, each comprising a shelf rack and a plurality of fasteners, wherein the fasteners are arranged on left and right sides of the shelf rack, and the fasteners are respectively fastened to the corresponding inclined holes to fix the storage layers between the post components; and a plurality of shelf boards, respectively arranged on the corresponding storage layer.

2. The concave square tube storage shelf according to claim 1, wherein each of the inclined holes has an inclined angle relative to the adjacent first plate portion or the second plate portion respectively.

3. The concave square tube storage shelf according to claim 1, wherein each of the first plate portions comprises an inclined angle relative to the adjacent second plate.

4. The concave square tube storage shelf according to claim 1, wherein each of the second plate portions comprises an inclined angle relative to the adjacent third plate.

5. The concave square tube storage shelf according to claim 1, wherein the fasteners are respectively divided into a first fastener and a second fastener, each of the storage layers comprises two first assemblies and two second assemblies, each of the first assemblies is provided with the first fasteners, and each of the second assemblies is provided with the second fasteners.

6. The concave square tube storage shelf according to claim 5, wherein each of the first assemblies is a Z-shaped hook structure, the first fasteners are fasteners of the Z-shaped hook structure, each of the second assemblies is an L-shaped hook structure, and each of the second fasteners is a fastener of the L-shaped hook structure.

7. The concave square tube storage shelf according to claim 1, wherein when the number of the at least one concave plate is multiple, each of the concave plates is provided with one of the inclined hole group; when the number of the at least one concave plate is one, the concave plate is provided with a plurality of inclined hole groups.

* * * * *